US009523261B2

(12) United States Patent
Flores et al.

(10) Patent No.: US 9,523,261 B2
(45) Date of Patent: Dec. 20, 2016

(54) HIGH FLOW RATE MULTI ARRAY STIMULATION SYSTEM

(75) Inventors: Antonio B. Flores, Houston, TX (US); David G. Ward, Houston, TX (US); David E. Nowowiejski, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 659 days.

(21) Appl. No.: 13/569,391

(22) Filed: Aug. 8, 2012

(65) Prior Publication Data

US 2013/0043043 A1 Feb. 21, 2013

Related U.S. Application Data

(60) Provisional application No. 61/525,525, filed on Aug. 19, 2011.

(51) Int. Cl.

| | |
|---|---|
| ***E21B 34/14*** | (2006.01) |
| ***E21B 43/26*** | (2006.01) |
| *E21B 43/267* | (2006.01) |
| *E21B 34/00* | (2006.01) |

(52) U.S. Cl.
CPC ..... *E21B 34/14* (2013.01); *E21B 43/26* (2013.01); *E21B 43/267* (2013.01); *E21B 2034/007* (2013.01)

(58) Field of Classification Search
CPC .... E21B 34/14; E21B 2034/007; E21B 43/26; E21B 43/267
USPC ..... 166/373, 374, 318, 332.4, 177.5
See application file for complete search history.

(56) References Cited

U.S. PATENT DOCUMENTS

| | | | | |
|---|---|---|---|---|
| 5,146,992 | A * | 9/1992 | Baugh | 166/383 |
| 8,215,411 | B2 * | 7/2012 | Flores et al. | 166/386 |
| 8,297,358 | B2 * | 10/2012 | Korkmaz et al. | 166/308.1 |
| 8,931,557 | B2 * | 1/2015 | Patterson et al. | 166/308.1 |
| 9,353,599 | B2 * | 5/2016 | Watson | E21B 34/14 |
| 2002/0157837 | A1 * | 10/2002 | Bode et al. | 166/373 |
| 2003/0127227 | A1 * | 7/2003 | Fehr et al. | 166/306 |
| 2007/0272411 | A1 * | 11/2007 | Lopez De Cardenas et al. | 166/305.1 |
| 2007/0284106 | A1 * | 12/2007 | Kalman et al. | 166/298 |
| 2008/0210429 | A1 * | 9/2008 | McMillin et al. | 166/313 |

(Continued)

FOREIGN PATENT DOCUMENTS

| | | |
|---|---|---|
| CA | 2776560 | 6/2011 |
| WO | 2009023611 | 2/2009 |

(Continued)

OTHER PUBLICATIONS

Dictionary definitions of "shifting" and "tool" accessed Jan. 6, 2016 via thefreedictionary.com.*

(Continued)

*Primary Examiner* — Blake Michener
(74) *Attorney, Agent, or Firm* — Blank Rome, LLP

(57) ABSTRACT

A system of sliding valves wherein the inserts of multiple sliding valves may be shifted to an open position using a single shifting ball. Each individual sliding valve has a movable insert that, depending upon the position of the insert within the sliding valve, may either block, permit fluid to radially flow between the interior and exterior of the sliding valve at a first rate, or permit fluid to radially flow between the interior and exterior of the sliding valve at some different second rate.

20 Claims, 6 Drawing Sheets

(56) References Cited

U.S. PATENT DOCUMENTS

| | | | | |
|---|---|---|---|---|
| 2009/0056934 | A1 | 3/2009 | Xu | |
| 2011/0108284 | A1* | 5/2011 | Flores et al. | 166/373 |
| 2011/0127047 | A1* | 6/2011 | Themig et al. | 166/386 |
| 2011/0192613 | A1* | 8/2011 | Garcia et al. | 166/373 |
| 2011/0284232 | A1* | 11/2011 | Huang | 166/317 |
| 2013/0043042 | A1* | 2/2013 | Flores et al. | 166/373 |
| 2013/0192846 | A1* | 8/2013 | Garcia et al. | 166/373 |
| 2014/0008071 | A1* | 1/2014 | Patterson | E21B 23/006 166/308.1 |
| 2014/0151052 | A1* | 6/2014 | Themig et al. | 166/308.1 |
| 2014/0262324 | A1* | 9/2014 | Greci et al. | 166/374 |
| 2014/0284058 | A1* | 9/2014 | Watson | E21B 34/14 166/308.1 |

FOREIGN PATENT DOCUMENTS

| | | | |
|---|---|---|---|
| WO | 2012/009099 | A1 | 1/2012 |
| WO | 2012/037645 | A1 | 3/2012 |

OTHER PUBLICATIONS

Patent Examination Report No. 1 received in corresponding Australian application No. 2012216239, dated Feb. 21, 2014.
Examiner's Requisition received in corresponding Canadian application No. 2,785,542, dated Jul. 14, 2014.
First Office Action in counterpart CA Appl, 2,785,542, dated Oct. 28, 2013.
Search Report and Written Opinion received in corresponding EP application No. 12 181 091.5, dated Jul. 27, 2015.

* cited by examiner

HIGH FLOW RATE MULTI ARRAY STIMULATION SYSTEM

CROSS-REFERENCE TO RELATED APPLICATION

This is a non-provisional application which claims priority to provisional application 61/525,525, filed Aug. 19, 2011, the contents of this application is incorporated herein by reference.

BACKGROUND

A common practice in producing hydrocarbons is to fracture the hydrocarbon bearing formation. Fracturing the hydrocarbon bearing formation increases the overall permeability of the formation and thereby increases hydrocarbon production from the zone fractured. Increasingly a single wellbore may intersect multiple hydrocarbon bearing formations. In these instances each hydrocarbon bearing zone may be isolated from any other and the fracturing operation proceeds sequentially through each zone.

In order to treat each zone sequentially a fracturing assembly is installed in the wellbore. The fracturing assembly typically includes of a tubular string extending generally to the surface, a wellbore isolation valve at the bottom of the string, various sliding sleeves placed at particular intervals along the string, open hole packers spaced along the string to isolate the wellbore into zones, and a top liner packer.

The fracturing assembly is typically run into the hole with the sliding sleeves closed and the wellbore isolation valve open. In order to open the sliding sleeves a setting ball, dart, or other type of plug is deployed into the string. For the purposes of the present disclosure a ball may be a ball, dart, or any other acceptable device to form a seal with a seat.

SUMMARY

The sliding sleeve has a movable insert that blocks radial fluid flow through the sliding sleeve when the sliding sleeve is closed. Fixed to the insert is a releasable seat that is supported about the seats periphery by the internal diameter of the housing. Upon reaching the first releasable seat the ball can form a seal. The surface fracturing pumps may then apply fluid pressure against the now seated ball and the corresponding releasable seat to shift open the sliding sleeve permanently locking it open. As the sliding sleeve and its corresponding seat shift downward the seat reaches an area where the releasable seat is no longer supported by the interior diameter of the housing causing the releasable seat to release the ball. The ball then continues down to seat in the next sliding sleeve and the process is repeated until all of the sliding sleeves that can be actuated by the particular ball are shifted to a permanently open position and the ball comes to rest in a ball seat that will not release it thus sealing the wellbore.

Once the lower wellbore is effectively sealed by the seated shifting ball and the sliding sleeves are open, the surface fracturing pumps may increase the pressure and fracture the hydrocarbon bearing formation adjacent to the sliding sleeves providing multiple fracturing initiation points in a single stage.

Because current technology allows multiple sliding sleeves to be shifted by a single ball size multiple hydrocarbon bearing zones may be fractured in stages where the lower set of sliding sleeves utilizes a small diameter setting ball and seat and successively higher zones utilize successively greater diameter setting ball and seat sizes.

A cluster of sliding sleeves may be deployed on a tubing string in a wellbore. Each sliding sleeve has an inner sleeve or insert movable from a closed condition to multiple opened or partially opened conditions. When the insert is in the closed condition, the insert prevents communication between a bore and a port in the sleeve's housing. To open the sliding sleeve, a ball is dropped into the wellbore and pumped to the first sliding sleeve where it forms a seal with the releasable seat. Keys or dogs of the insert's seat extend into the bore and engage the dropped ball, providing a seat to allow the insert to be moved open with applied fluid pressure. After opening, the external diameter of the housing is in fluid communication with the interior portion of the housing through the ports in the housing.

When the insert reaches its open position the keys retract from the bore and allow the ball to pass through the seat to another sliding sleeve deployed in the wellbore. This other sliding sleeve can be a cluster sleeve that opens with the same ball and allows the ball to pass through after opening. Eventually, however, the ball can reach an isolation tool or a single shot sliding sleeve further down the tubing string that opens when the ball engages its seat but does not allow the ball to pass through. Operators can deploy various arrangements of cluster and isolation sleeves for different sized balls to treat desired isolated zones of a formation.

After the various sliding sleeves are actuated it is sometimes necessary to run a milling tool through the wellbore to ensure that the inner diameter of the tubular is optimized for the fluid flow of the particular well. The mill out may include removing portions of sliding sleeve ball seats that are not releasable and any other debris that may be left over from the fracturing process.

At some point during the life of the well it may become desirable to change the flow characteristics of the fluids in the wellbore. Typically after fracturing the first set of ports in the sliding sleeve do not have sufficient area to maximize fluid flow through the wellbore to the surface. The first set of ports becomes the flow restriction in the well. In order to maximize the fluid flow it may be necessary to access a second set of ports. The second set of ports may be configured to add their flow area to that of the first set of ports to achieve an at least equal flow area to that of the tubular string.

It may be desirable to shut off flow through the first set of ports and have all of the fluid flow through the second set of ports. In the case where all of the fluid flows through the second set of ports the ports may be configured to match the flow area of the tubular string.

A typical configuration of a sliding sleeve has at least two sliding sleeves. Each sliding sleeve in turn typically having a housing having an outer housing diameter, an inner housing diameter, a first port allowing fluid communication between the inner housing diameter and the outer housing diameter, and a second port longitudinally offset from the first port that allows fluid communication between the inner housing diameter and the outer housing diameter. Each sliding sleeve also has an insert typically located within the inner housing diameter. Each insert has an outer insert diameter, an inner insert diameter, a releasable seat, and a shifting profile. Each insert is typically located in the inner housing diameter so that it has a first position within the inner housing diameter where fluid flow through the at least first and second ports is blocked.

A shifting ball pumped down from the surface actuates the releasable seat to facilitate movement of the insert between a first position and a second position wherein the insert allows fluid flow through the first port; after the insert is moved from its first position to its second position the shifting ball is released.

A shifting tool may then be run into the wellbore on coiled tubing, a wellbore tractor, or any other device that may supply the necessary force to actuate the insert from its second position to a third position. The shifting tool may be operated from surface as when coiled tubing is used, it may be operated remotely such as by a wellbore tractor on an electric or hydraulic line, or it may be operated by any other remote means that can supply sufficient force to move the insert from one position to any other such as from the second open position to the closed position or from the second open position to the first open position.

The insert's third position allows fluid flow through at the second port. As the insert is moved between the second and third positions the first and second ports may be arranged such that in the second position fluid flow through the second port may be blocked and when the insert is in the third position fluid flow through the first port may be blocked. In some cases it may be desirable to allow fluid flow through both the first and second ports when the insert is in its third position.

The first port may consist of a series of ports in approximately the same longitudinal position around the sliding sleeves' housing. The second port is longitudinally offset from the first port but may also consist of a series of ports in approximately the same longitudinal position around the sliding sleeves' housing. The first port and the second port may not have the same cross-sectional area nor is it necessary that each port within the first ports or second ports have the same cross-sectional area.

An alternate configuration of a downhole well fluid system is a plurality of sliding sleeves having a central throughbore and attached to tubing string that is run into a wellbore. Each of the sliding sleeves is typically actuated by a single ball pumped down the tubing string. The sliding sleeves have a closed condition and at least two open conditions and each sliding sleeve is able to be actuated from a closed condition to a first opened condition.

The closed condition prevents fluid from radially flowing between the central throughbore and the wellbore and the first opened condition allowing radial fluid communication between the central throughbore and the wellbore. Each of the sliding sleeves in the opened condition allowing the single ball to pass therethrough.

Each of the sliding sleeves may be changed from a first opened condition to a second opened condition. The second opened condition typically permitting increased fluid flow between the central throughbore and the wellbore than the first opened condition. The ports in the sliding sleeve may be arranged so that the sliding sleeve in the second open condition blocks fluid flow through the first ports.

It may be advisable to arrange the ports such that fluid communication between the central throughbore and the wellbore is greater in the second open condition than in the first open condition. However, in some instance it may be necessary to arrange the ports in the sliding sleeves such the second open condition allows fluid flow through both the first ports and the second ports. In some cases the sliding sleeve in the first open condition blocks radial fluid communication through the second ports.

A shifting tool may be run into the wellbore on coiled tubing, a wellbore tractor, or any other device that may supply the necessary force to actuate a sliding sleeves from its second position to a third position. The shifting tool may be operated from surface as when coiled tubing is used, it may be operated remotely such as by a wellbore tractor on an electric or hydraulic line, or it may be operated by any other remote means that can supply sufficient force to move the insert from one position to any other.

A wellbore fluid treatment method may include deploying at least two sliding sleeves on a tubing string in a wellbore, each of the sliding sleeves having a housing, an outer diameter, an inner diameter, a central throughbore, a first port allowing radial fluid communication between the central throughbore and the wellbore, a second port longitudinally offset from the first port allowing radial fluid communication between the central throughbore and the wellbore, and a closed condition preventing radial fluid communication between the central throughbore and the wellbore.

Typically a ball is pumped or dropped down the tubing string to change the sliding sleeves from a closed condition to a first open condition allowing access to the first port. The ball is then released from the sliding sleeve and in many cases actuates another lower sliding sleeve.

At some time after the shifting ball has been released from the sliding sleeve a shifting tool is run down the tubing string to change the sliding sleeve from the first open condition to a second open condition allowing access to the second port. Depending upon the needs of the operator changing between the first open condition and the second open condition seals the first port or perhaps changing between the first open condition and the second open condition allows access to both second port and the first port. Depending upon the wellbore conditions changing between the first open condition and the second open condition allows or restricts access to various ports and radial fluid flow may increase or decrease.

The foregoing summary is not intended to summarize every potential embodiment of the present invention.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
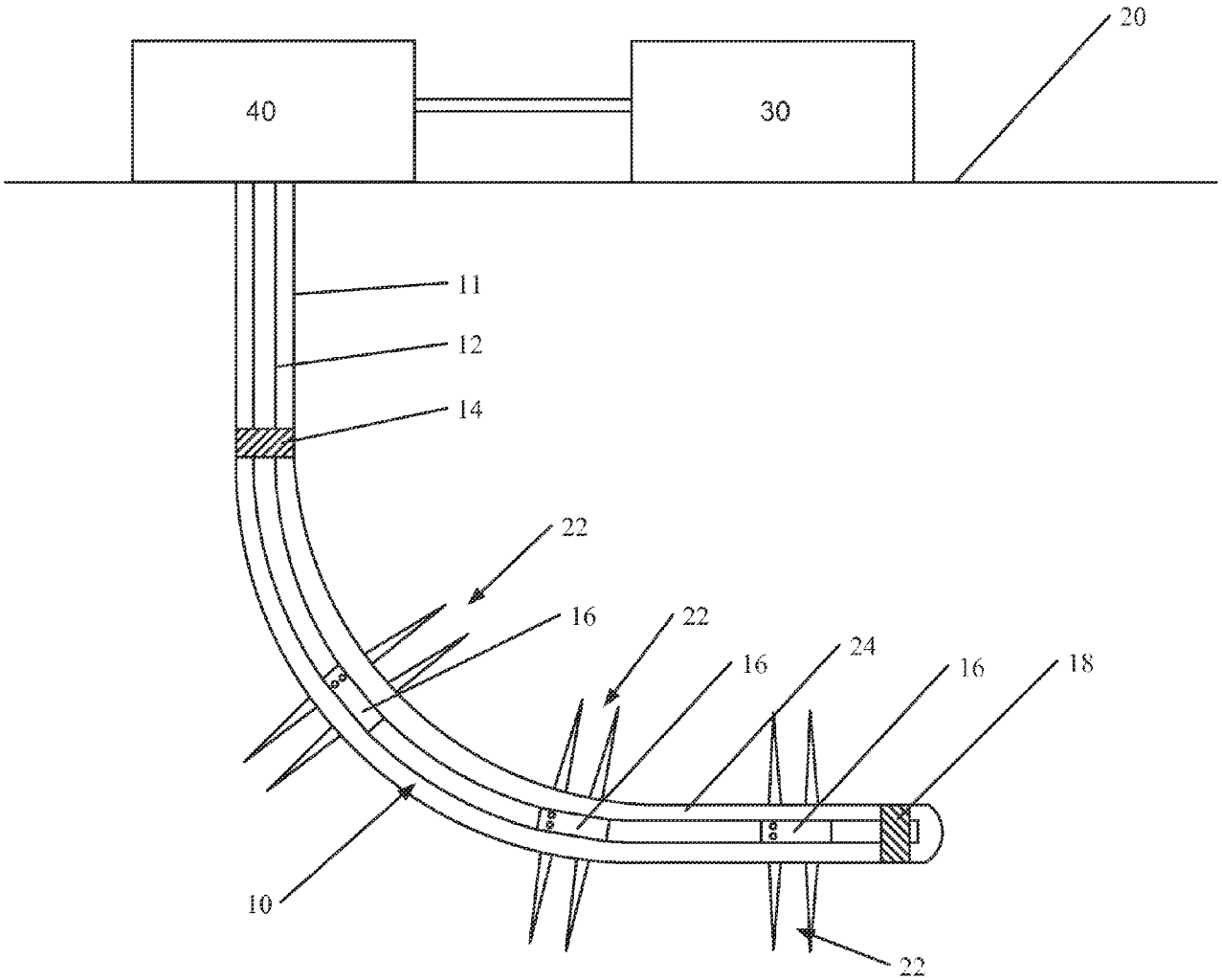
FIG. 1 depicts a schematic view of a fracturing assembly installed in a wellbore.

FIG. 1 depicts a schematic view of a wellbore 11 with a single zone and having a fracturing assembly 10 therein. The fracturing assembly 10 typically consists of a tubular string 12 extending to the surface 20, an open hole packer 14 near the upper end of the sliding sleeves 16, and a wellbore isolation valve 18. At the surface 20, the tubular string 12 is connected to the fracturing pumps 30 through the rig 40. The fracturing pumps 30 supply the necessary fluid pressure to activate the sliding sleeves 16. The open hole packer 14 at the upper end of the sliding sleeves 16 isolates the upper end of the formation zone 22 being fractured. At the lower end of the sliding sleeves 16 a wellbore isolation valve 18 is placed to seal the lower end of the formation zone 22 being fractured.

The fracturing assembly 10 may be assembled and run into the wellbore 11 for a predetermined distance such that the wellbore isolation valve 18 is past the end of the formation zone 22 to be fractured, the open hole packer 14 is above the formation zone 22, and the sliding sleeves 16 are distributed in the appropriate places along the formation zone 22. Typically, when the fracturing assembly 10 is run into the wellbore 11 each of the sliding sleeves 16 are closed, the wellbore isolation valve 18 is open, and the open hole packer 14 is not set.

Figure 2:
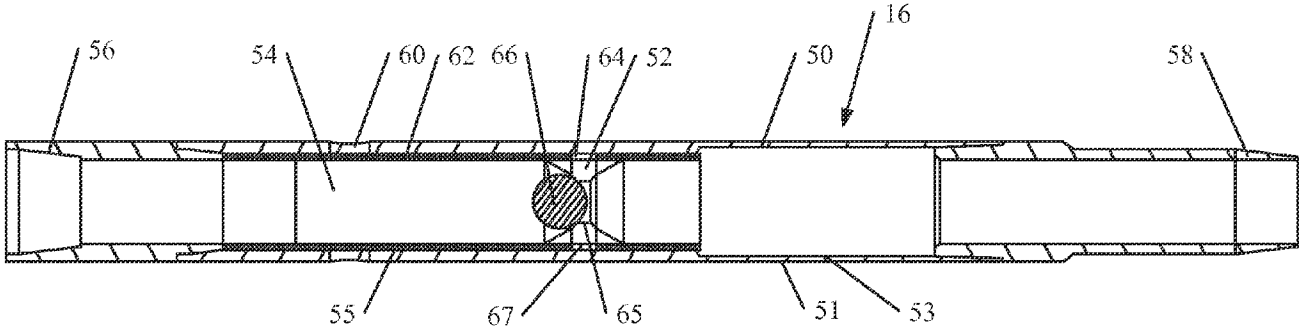
FIG. 2 depicts a sliding sleeve with a releasable seat in the closed position.

As depicted in FIG. 2, once the fracturing assembly 10 is properly located in the wellbore lithe operator pumps down a shifting ball, dart, or other type of plug 66 to shift open the desired sliding sleeves 16. Upon reaching the first appropriately sized releasable seat 52 the ball 66 can form a seal.

Figure 3:
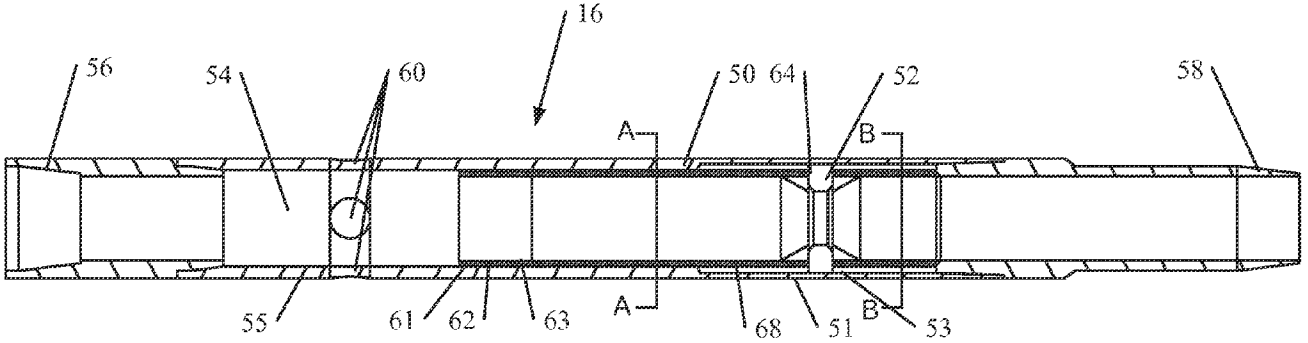
FIG. 3 depicts a sliding sleeve with a releasable seat in the open position.
Figure 3B:
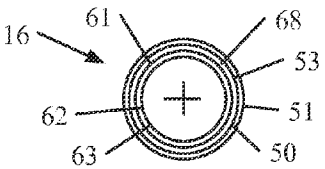
Figure 3A:
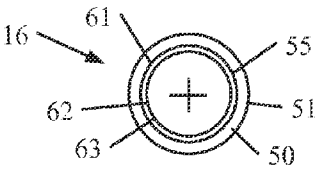

The ball 66 forms a seal with seat 52 in sliding sleeve 16, where the sleeve is in a closed position with a type of releasable ball seat 52 such as is used in WEATHERFORD'S MULTI ARRAY STIMULATION SYSTEM. FIG. 3 depicts the sliding sleeve 16 in the open position and includes like reference numbers. As depicted in the cross-section of FIG. 3 depicted in FIG. 3AA, the sliding sleeve 16 has a housing 50, with an outer diameter 51, an inner diameter 53 defining a longitudinal bore therethrough 54, and having ends 56 and 58 for coupling to the tubular string 12. Ports 60 are formed in the housing 50 to allow fluid communication between the interior of the housing 50 and the exterior of the housing 50. Located about the interior of the housing 50 is an inner sleeve or insert 62 having an outer insert diameter 61 and an inner housing diameter 63 that is movable between an open position (see FIG. 3) and a closed position (see FIG. 2). The insert 62 has slots 64 formed about its circumference to accommodate the releasable seat 52. The releasable seat 52 is supported about its exterior diameter by the inner diameter of the housing 50.

Conventionally, the operator uses the fracturing pumps 30 to force a shifting ball 66 down the wellbore 11. When the shifting ball 66 engages and seats on the releasable seat 52 a seal is formed. The fluid pressure above the shifting ball 66 is increased by the fracturing pumps 30 causing the releasable seat 52 and its corresponding insert 62 to move towards the bottom of the wellbore 11. As the insert 62 moves towards the bottom the wellbore ports 60 are uncovered allowing radial access between the interior portion of the housing 50 or the housing longitudinal bore 54 and the exterior portion of the housing 50 accessing the formation zone 22. As the releasable seat 52 and insert 62 move together, the releasable seat 52 reaches an at least partially circumferential slot 68 as depicted in the cross-section of FIG. 3 depicted in FIG. 3BB. The at least partially circumferential slot 68 may be located in the inner diameter of the housing 50 where typically material has been milled away to increase the inner diameter of the housing 50. Before the shifting ball 66 actuates the sliding sleeve 16 and thereby moving the releasable seat 52 and insert 62, the releasable seat 52 is supported by the inner diameter of the housing 55. As the outer diameter of the releasable seat 67 reaches the slot 68 the releasable seat 52 recesses into the at least partially circumferential slot 68. Typically, the releasable seat 52 recesses into the at least partially circumferential slot 68 because as the releasable seat 52 and insert 62 move down, the releasable seat 52 is no longer supported by the inner diameter of the housing 53 causing the outer diameter of the releasable seat 67 to move into the at least partially circumferential slot 68 and thereby causing a corresponding increase in the inner diameter 65 of the releasable seat 52 thereby allowing the shifting ball 66 to pass through the sliding sleeve 16.

Figure 4B:
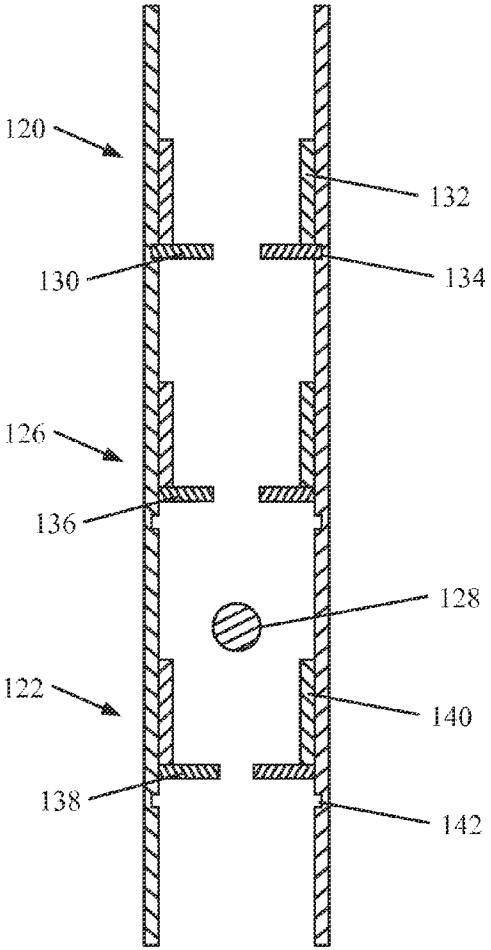
FIG. 4B depicts an array sliding sleeves using at least two different sizes of ball during activation.
Figure 4A:
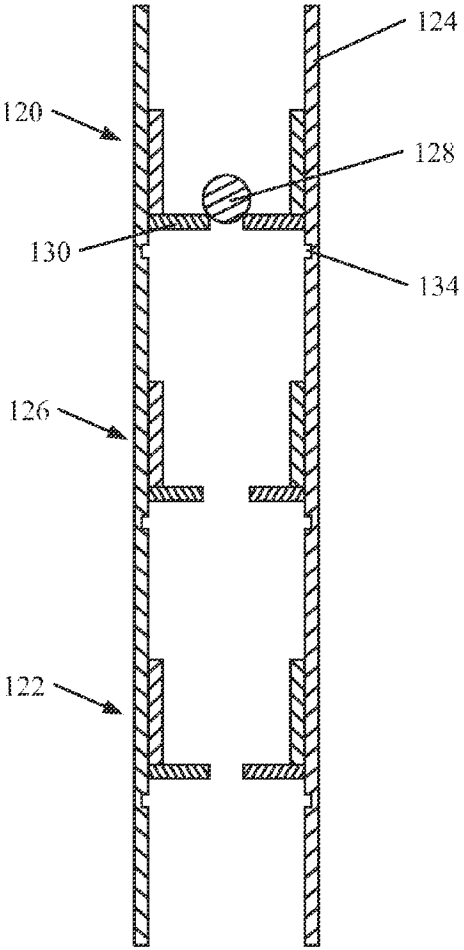
FIG. 4A depicts an array sliding sleeves using at least two different sizes of ball prior to activation.

Typically the sliding sleeves 16 are grouped together such that those sliding sleeves 16 actuated by a particular shifting ball size are located sequentially near one another. However it is sometimes desirable to open the sliding sleeves in a non-sequential manner. For example such as when interspersing at least three sliding sleeves actuated by different shifting balls sizes. In these instances while several sliding sleeves in the wellbore 11 may be shifted by shifting balls of the same size, these sliding sleeves do not have to be sequentially located next to one another. For example as depicted in FIG. 4A sliding sleeves 120 and 122 are located in a tubular string 124 and are actuated by the same sized shifting ball 128. In FIG. 4A sliding sleeves 120 and 122 are placed above and below a third sliding sleeve 126 that is actuated by a different sized but larger shifting ball (not shown). The smaller shifting ball 128 can then be pumped down the well where it lands on the first releasable seat 130 in sliding sleeve 120. As depicted in FIG. 4B pressure from the fracturing pumps 30 (FIG. 1) against the shifting ball 128 and the corresponding releasable seat 130 forces the insert 132 and the first releasable seat 130 downwards until the releasable seat reaches the circumferential slot 134. The releasable seat 130 then moves outwardly into the circumferential slot 134 thereby increasing the inner diameter of the releasable seat 130 and releasing the shifting ball 128. The releasable seat 136 has a large enough diameter that shifting ball 128 passes through sliding sleeve 126 without actuating sliding sleeve 126. The shifting ball 128 will then land on the second releasable seat 138 forcing the insert 140 and the second releasable seat 138 downwards until the releasable seat reaches the circumferential slot 142. The second releasable seat 138 then moves outwardly into the circumferential slot 142 thereby increasing the inner diameter of the releasable seat 138 and releasing the shifting ball 128.

After actuating the correspondingly sized sliding sleeves the shifting ball may then seat in the wellbore isolation tool 18 or actuate any other tool to seal against the wellborel 1. Fluid is then diverted out through the ports 60 in the sliding sleeves 16 and into the annulus 24 created between the tubular string 12 and the wellbore 11.

In order to isolate the formation zone 22 the open hole packer 14 and the packer associated with the wellbore isolation valve 18 may be set above and below the sliding sleeves 16 to isolate the formation zone 22 and the portion of the sliding sleeves 16 from the rest of the wellbore.

The fracturing pumps 30 are now able to supply fracturing fluid at the proper pressure to fracture only that portion of the formation zone 22 that has been isolated. After the formation 22 has been fractured any hydrocarbons may be produced.

Typically the port 60 used during the fracturing process has a smaller cross-sectional area than the tubular string 12. As any produced fluids travel out of the formation zone 22 and into the tubular string 12 the port 60 becomes a flow restriction for the produced fluids. In order to overcome the potential flow restriction it may be advisable to place a second set of flow ports around the sliding sleeve's housing.

Figure 5:
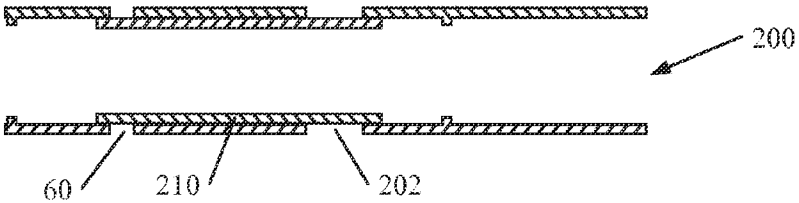
FIG. 5 depicts a high flow sliding sleeve with the ports closed.

FIG. 5 depicts a cross-sectional view of a sliding sleeve 200 having a port 60 and a second port 202 longitudinally offset from the port 60. When the sliding sleeve 200 is run into the wellbore 11 (FIG. 1) the insert 210 is in the closed position where radial fluid flow through port 60 and second port 202 is blocked.

Figure 6:
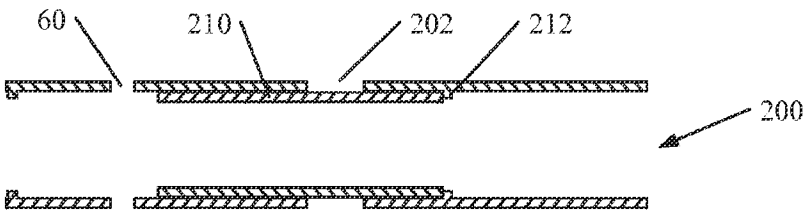
FIG. 6 depicts a high flow sliding sleeve with the fracturing ports open.

FIG. 6 depicts a cross-sectional view of a sliding sleeve 200 having a port 60 and a second port 202 longitudinally offset from the port 60. After the sliding sleeve 200 is run into the well the shifting ball 66 (FIG. 2) forms a seal with the releasable seat 52 (FIG. 2) to force the insert 210 to move down against a lower stop 212. The exposing port 60 and allowing radial fluid flow through port 60 between the interior and the exterior of the sliding sleeve 200 and the shifting ball 66 (FIG. 2) is released. The operator is now able to fracture the formation zone 22 (FIG. 1).

When the formation zone 22 (FIG. 1) is fractured small ports are desired to maintain a high enough pressure profile through the relevant fracturing assembly 10 (FIG. 1) to ensure that the formation zone 22 (FIG. 1) is fractured according to plan. After fracturing the formation zone 22 (FIG. 1) the operator can begin to produce the well. Because typically the port 60 has a smaller cross-sectional area that the tubular string 12 (FIG. 1) and fracturing assembly 10 (FIG. 1) including the sliding sleeve 200 and insert 210 port 60 is now a flow restriction for produced fluids. It is therefore desirable to have a simple means to increase the total ability of the sliding sleeve to provide radial fluid flow between the exterior of the sliding sleeve and the interior of the sliding sleeve.

Figure 7:
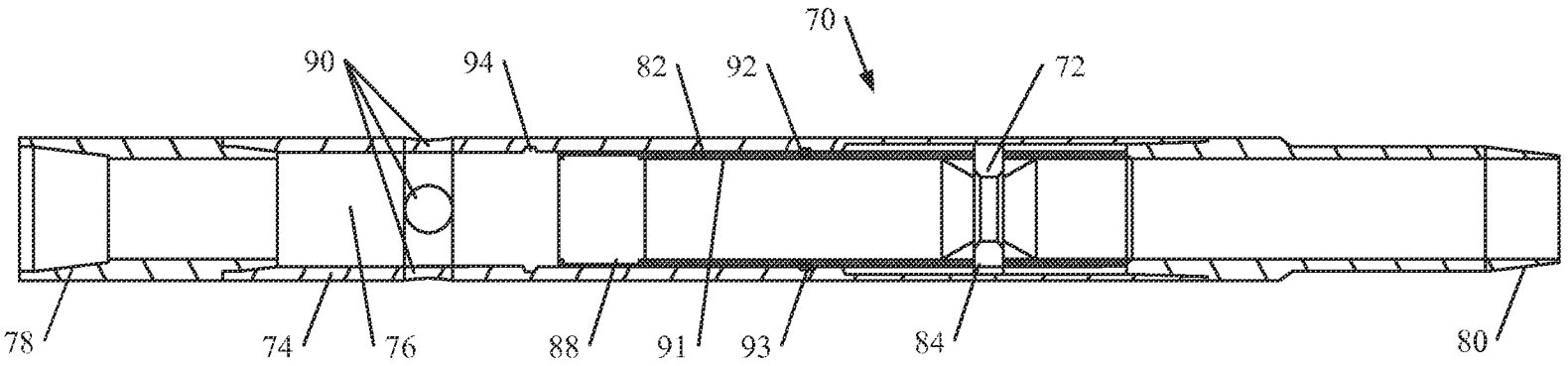
FIG. 7 depicts a sliding sleeve with a releasable seat in the open position and having a shifting profile.

FIG. 7 depicts a sliding sleeve 70 with a type of releasable ball seat 72 in the open position allowing fluid communication through the ports 90 between the interior of the housing and the exterior of the housing. The sliding sleeve 70 has a housing 74 defining a longitudinal bore 76 therethrough and having ends 78 and 80 for coupling to the tubing string. Located about the interior of the housing is an inner sleeve or insert 82 that is movable between an open position and a closed position. The insert 82 has slots 84 formed about its circumference to accommodate the releasable seat 72. The insert 82 has a profile 88 formed about the inner insert diameter 91. The profile 88 is typically formed by circumferentially milling away a portion of material around at least one end of the inner insert diameter 91. The releasable seat 72 is supported around the outer diameter of the releasable seat 72 by the inner diameter of the housing 74. A snap ring 93 is provided in circumferential slot 92 about the exterior diameter of insert 82. The snap ring 93 latches into circumferential slot 92 about the interior diameter of the housing 74 to retain the insert 82 in an open position. As the insert 82 is moved between an open position and a closed position the snap ring 93 will retract into circumferential slot 92 until it reaches circumferential slot 94 about the interior diameter of the housing where it will expand into circumferential slot 94 and thereby retaining the insert 82 in the closed position.

Figure 8A:
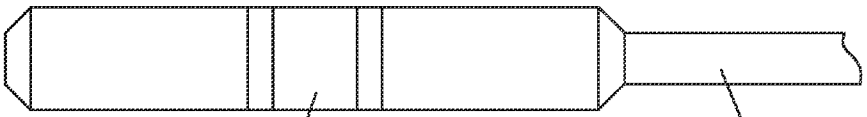
FIG. 8A depicts a shifting tool with the radially movable latch in the retracted position attached to coiled tubing.

FIG. 8A depicts a shifting tool 100 having a radially movable latch 102A to latch into profile 88. The shifting tool 100 may be run into the fracturing assembly 10 on coiled tubing 106, by a wellbore tractor, or by any other means that can carry the shifting tool 100 into the fracturing assembly 10. Typically the shifting tool may be run into the wellbore 11 with the movable latch in a radially retracted position 102A reducing the outer diameter of the shifting tool 100 and allowing the shifting tool 100 to clear any areas of reduced diameter inside of the fracturing assembly 10.

Figure 8B:
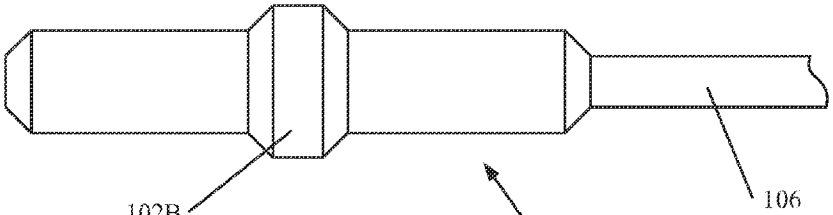
FIG. 8B depicts a shifting tool with the radially movable latch in the extended position attached to coil tubing.
Figure 8C:
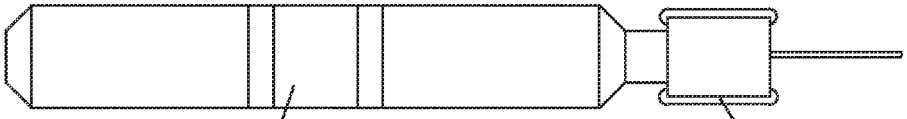
FIG. 8C depicts a shifting tool with the radially movable latch in the extended position attached to a wellbore tractor.

FIG. 8B depicts a shifting tool 100 with the radially movable latch 102B in its extended position. Once the shifting tool 100 is located in the profile 88 the movable latch is actuated from its radially retracted position 102A to its radially extended position 102B and engages profile 88 (FIG. 7) within the insert 82 (FIG. 7). Tension is then applied to move the shifting tool 100 and thereby insert 82 from its open position to its closed position to block fluid flow between the exterior of the housing 74 through the ports 90 and into the interior of the housing. Typically the tension is applied from the rig 40 (FIG. 1) on the surface however, as depicted in FIG. 8C any device such as an electrically (electric line 110) or hydraulically driven wellbore tractor 108 that can provide sufficient force to the shifting tool 100 to shift the insert 82 may be used.

Once the insert 82 is moved to its closed position tension from the surface on the shifting tool 100 is reduced. The movable latch on 102 on shifting tool 100 is moved from its extended position to its retracted position thereby disengaging profile 88. The shifting tool may then be moved to its next position to shift the insert on another tool or the shifting tool may be retrieved from the wellbore.

Figure 9:
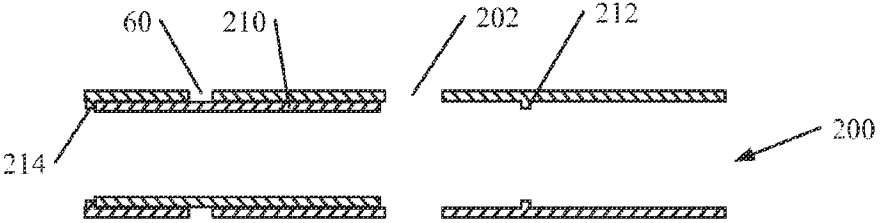
FIG. 9 depicts a high flow sliding sleeve with the high flow ports open.
Figure 10:
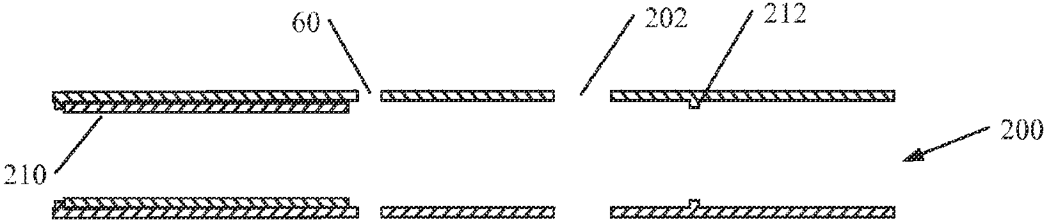
FIG. 10 depicts a high flow sliding sleeve with the fracturing ports and the high flow ports open.

FIG. 9 depicts a cross-sectional view of a sliding sleeve 200 having a port 60 and a second port 202 longitudinally offset from the port 60. After fracturing the formation zone 22 (FIG. 1) the total radial fluid flow between the exterior of the sliding sleeve and the interior of the sliding sleeve may be increased by utilizing a shifting tool 100 (FIG. 8A) to engage the shifting profile 88 (FIG. 7) to shift the insert 210 upwards against the upper stop 214 thereby allowing radial fluid flow through second port 202. Typically second port has a larger cross-sectional area than port 60. Each port 60 and second port 202 may include multiple openings spaced circumferentially around the sliding sleeve. Depending upon the particular characteristics desired second port 202 could have a larger, a smaller, or the same cross-sectional area as port 60. Also depending upon the particular characteristics desired the second port 202 and the port 60 can be opened together (as illustrated in FIG. 10)or in any order desired.

While the embodiments are described with reference to various implementations and exploitations, it will be understood that these embodiments are illustrative and that the scope of the inventive subject matter is not limited to them. Many variations, modifications, additions and improvements are possible. For example, the method of shifting the insert between an open position and a closed position as described herein is merely a single means of applying force to the sliding sleeve and any means of applying force to the sliding sleeve to move it between an open and a closed position may be utilized.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole assembly comprising at least two sliding sleeves actuatable by a shifting ball and a shifting tool, each sliding sleeve further comprising:

a housing having an inner bore, a first port allowing fluid communication with the inner bore, and a second port allowing fluid communication with the inner bore, the second port longitudinally offset from the first port; and an insert located within the inner bore of the housing and having a releasable seat, wherein the insert in a first position within the housing blocks fluid flow through the first and second ports;

the releasable seat being engagable by the shifting ball to move the insert from the first position to a second position, wherein the insert in the second position allows fluid flow through the first port and blocks fluid flow through the second port, and wherein the releasable seat in the second position releases the shifting ball; and the insert being further engagable by the shifting tool run into the slding sleeve to move the insert from the second position to a third position, wherein the insert in the third position allows fluid flow through at least the second port;

wherein the releasable seat of each of the at least two sliding sleeves is engagable by the same shifting ball, and wherein the insert of each of the at least two sliding sleeves is engagable by the same shifting tool.

2. The downhole assembly of claim 1, wherein the insert in the third position allows fluid flow through the first port and the second port.

3. The downhole assembly of claim 1 wherein the cross-sectional area of the first port is less than the cross-sectional area of the housing.

4. The downhole assembly of claim 1 wherein the combined cross-sectional area of the first port and the second port is approximately equal to or greater than the cross-sectional area of the housing.

5. The downhole assembly of claim 1, wherein the shifting tool run into the sliding sleeve is moved by coiled tubing.

6. The downhole assembly of claim 1, wherein the shifting tool run into the sliding sleeve is moved by a wellbore tractor.

7. The downhole assembly of claim 1, wherein the insert comprises a shifting profile engaged by the shifting tool run into the sliding sleeve and operated from the surface.

8. A downhole well fluid system actuatable by a single ball, comprising:

a plurality of sliding sleeves having a central throughbore and disposed on a tubing string deployable in a wellbore;

each of the sliding sleeves having an insert being actuatable by the single ball deployable down the tubing string;

each of the inserts in the sliding sleeves, actuated by the single ball, moving between a closed condition and a first opened condition, the insert in the closed condition preventing fluid communication between the central throughbore and the wellbore, the insert in the first opened condition permitting fluid communication between the central throughbore and the wellbore;

each of the inserts in the sliding sleeves in the first opened condition allowing the single ball to pass therethrough; and each of the inserts in the sliding sleeves being further movable between the first opened condition and a second opened condition, the second opened condition permitting increased fluid communication between the central throughbore and the wellbore than the first opened condition; wherein the sliding sleeves are actuatable by a shifting tool run into the sliding sleeves; and wherein the run-in shifting tool engages the sliding sleeve to actuate the sliding sleeves between the first opened condition and the second opened condition.

9. The downhole assembly of claim 8, wherein the sliding sleeve in the second open condition blocks fluid communication through the first ports.

10. The downhole assembly of claim 9, wherein fluid communication between the central throughbore and the wellbore is greater in the second open condition than in the first open condition.

11. The downhole assembly of claim 8, wherein the sliding sleeve in the second open condition allows fluid communication through one or more first ports.

12. The downhole assembly of claim 8, wherein the sliding sleeve in the first open condition blocks fluid communication through one or more second ports.

13. The downhole assembly of claim 8, wherein the shifting tool run, into the sliding sleeves is operated from the surface.

14. The downhole assembly of claim 8, wherein the shifting tool run into the sliding sleeves is moved by coiled tubing.

15. The downhole assembly of claim 8, wherein the shifting tool run into the sliding sleeves is moved by a wellbore tractor.

16. The downhole assembly of claim 8, wherein the shifting tool run into the sliding sleeves is operated remotely.

17. A wellbore fluid treatment method, comprising:

deploying at least two sliding sleeves on a tubing string in a wellbore, each of the sliding sleeves having a central throughbore, a first port allowing fluid communication between the central throughbore and the wellbore, a second port longitudinally offset from the first port and allowing fluid communication between the central throughbore and the wellbore, and an insert in a closed condition preventing radial fluid communication between the central throughbore and the wellbore;

dropping a ball down the tubing string;

using the ball to move the inserts in each of the sliding sleeves between the closed condition and a first open condition allowing fluid communication through the first ports;

releasing the ball from the sliding sleeves;

running a shifting tool down the tubing string into at least one of the sliding sleeves; and using the run-in shifting tool to move the insert in the at least one of the sliding sleeves between the first open condition and a second open condition allowing fluid communication through the second port.

18. The method of claim 17 wherein moving the insert between the first open condition and the second open condition seals the first port.

19. The method of claim 17 wherein moving the insert between the first open condition and the second open condition allows fluid communication through both the second port and the first port.

20. The method of claim 19 wherein moving the insert between the first open condition and the second open condition increases fluid flow.

* * * * *